US006648681B2

(12) United States Patent
Ushiro et al.

(10) Patent No.: US 6,648,681 B2
(45) Date of Patent: Nov. 18, 2003

(54) CONNECTOR WITH RETAINER MEMBERS ATTACHABLE TO PANEL FROM EITHER FRONT OR BACK WALL FACE THEREOF AND METHOD OF ATTACHING THE CONNECTOR TO THE PANEL

(75) Inventors: Yutaka Ushiro, Yokohama (JP); Katsuyuki Masaki, Yokohama (JP); Yusuke Hamada, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/327,883

(22) Filed: Dec. 26, 2002

(65) Prior Publication Data

US 2003/0124907 A1 Jul. 3, 2003

(30) Foreign Application Priority Data

Dec. 28, 2001 (JP) ..... 2001-402057

(51) Int. Cl.[7] ..... H01R 13/73
(52) U.S. Cl. ..... 439/557; 439/562; 439/563
(58) Field of Search ..... 439/557, 562, 439/563, 565, 567, 570, 549, 552, 553

(56) References Cited

U.S. PATENT DOCUMENTS 4,722,136 A * 2/1988 Justiano et al. ..... 29/837
4,836,804 A * 6/1989 London et al. ..... 439/598
5,514,000 A * 5/1996 Krause et al. ..... 439/248
5,893,764 A * 4/1999 Long ..... 439/79
5,984,722 A * 11/1999 Ito ..... 439/567
6,056,596 A * 5/2000 Etiembre ..... 439/572
6,383,018 B2 * 5/2002 Torii ..... 439/557

FOREIGN PATENT DOCUMENTS

JP 4-21270 5/1992

* cited by examiner

*Primary Examiner*—Dean A. Reichard
*Assistant Examiner*—Jinhee Lee
(74) *Attorney, Agent, or Firm*—Armstrong, Westerman & Hattori, LLP

(57) ABSTRACT

A connector with retainer members attachable to a panel from a direction of either a front or back wall face thereof, and easily removable from the panel. The connector comprises an insulating housing having a through hole therein with connector terminals fitted in the through-hole, flanges orthogonal to a direction of insertion and removal through the insulating housing and projected outwardly from at least one wall face of the insulating housing, comprising front and back wall faces, respectively, and a pair of retainer members having flexibility, fixedly attached to both side ends or both up-down ends of the insulating housing, respectively. The retainer members are provided with a pair of retainer stepped parts, facing each other, and there is a gap for allowing fixture of the panel between the front and back wall faces of the respective flanges and the respective retainer stepped parts of the retainer members.

8 Claims, 6 Drawing Sheets

CONNECTOR WITH RETAINER MEMBERS ATTACHABLE TO PANEL FROM EITHER FRONT OR BACK WALL FACE THEREOF AND METHOD OF ATTACHING THE CONNECTOR TO THE PANEL

FIELD OF THE INVENTION

The invention relates to a connector with retainer members, concerning improvement of the retainer members, particularly to a connector with retainer members attachable to a panel of electronic or electrical equipment from either a front or back wall face thereof when attaching the connector to the panel, and a method of attaching the connector to the panel.

BACKGROUND OF THE INVENTION

As a connector for attachment to a panel of an electronic equipment, electrical equipment, or the like, there has been in widespread use a connector having a pair of elastic retainer arms installed on the sidewalls of a housing proper thereof, which is publicly known. An example of such a connector is disclosed in JU-B 4-21270. FIGS. 6(A) to 6(C) show a connector disclosed in JU-B 4-21270, wherein FIG. 6(A) is a perspective view of the connector, FIG. 6(B) and FIG. 6(C) are partially enlarged views of the elastic retainer arms when the connector is attached to a panel.

As shown in FIG. 6(A), a connector 100 is made up of an insulating housing in box shape, a pair of elastic retainer arms 120, 120 are installed at substantially intermediate position on sidewalls 110, 110, on both sides of the insulating housing, respectively, so as to extend outwardly from the sidewalls 110, 110. The elastic retainer arms 120, 120 each have flexibility enabling them to undergo flexure towards the respective sidewalls when subjected to external force. When the connector 100 is inserted into an attachment port 210 of a panel 200 from the direction of the arrow in FIG. 6(A), the pair of elastic retainer arms 120, 120 undergo flexure towards the sidewalls, respectively, against the urging of elastic force thereof, and are inserted into the attachment port 210. As the connector 100 is inserted deeper into the attachment port 210, a notched part 130, provided at the extremity of both the elastic retainer arms 120, 120, is butted against a recess 220 provided on both sides of the attachment port 210, and is caused to undergo flexure inwardly due to pressing force exerted by the recess 220. When the connector 100 is further pushed into the attachment port 210, the notched part 130 is shifted from a notch 130N at the foot thereof towards a notch 130A at the tip thereof.

Such shifting of the notched part 130 continues until a collar 140 of the connector 100 is butted against the panel 200. Upon butting of the collar 140 against the panel 200, the direction of insertion is established and simultaneously, the notched part 130 is secured by pressing force of the recess 220 on each side. The notched part 130 of the respective elastic retainer arms 120, 120 is provided with a plurality of the notches 130A, 130B . . . 130N, formed thereon, and the respective elastic retainer arms 120, 120 are retained at any notch of the plurality of the notches in such a way as to correspond to a thickness of a panel plate.

However, with the connector comprising the elastic retainer arms described above, a direction of attachment of the connector to a panel is limited to that from one wall face of the panel owing to a structure of retainer members of the connector, and usually, the connector can be attached only from the direction of the arrow in FIG. 6(A). If attachment of the connector from a wall face on the opposite side is attempted, this will cause the orientation of the connector to become opposite to that shown in FIG. 6(A), resulting in a change in a position of connection with another connector. Further, in order to render the orientation of the connector to be the same as the direction of connection even when the connector is attached from the wall face on the same side, there has been the need for preparing a connector with retainer members fitted to the sidewalls, in a different direction. For this reason, two different kinds of connectors are required, which has resulted in an increase in inventories, and has become uneconomical. At the same time, there has been no choice but to place severe limitations on design flexibility in connection with connectors, and attachment thereof to a panel, or the like. Since the elastic retainer arm is made up of an elastic piece in the form of a cantilever, the elastic retainer arm undergoes deformation or breakage if a foreign matter is caught in a gap or the elastic retainer is subjected to an external stress unexpectedly. Further, the elastic retainer arms undergo flexure towards the respective sidewalls against the urging of elastic force thereof at the time of the connector being attached to, or removed from the panel, whereupon stress is concentrated on the root of the respective elastic retainer arms, where the same are attached to the sidewalls, respectively, due to the flexure, and consequently, the root of the respective elastic retainer arms needs to be firmly secured to the sidewall in order to maintain a predetermined elastic force and to prevent breakage. However, the firmer the root of the respective elastic retainer arms is secured to the sidewall, the more the elastic force of the respective elastic retainer arms has to be sacrificed, so that greater force is required when fitting the connector into the panel while there is limitation to force of retaining the connector to the panel, thereby causing a problem of insufficient stability.

Meanwhile, there has been in widespread use another method of attachment by use of a connector provided with screws in place of the elastic retainer arms described above, enabling attachment from either a front wall face or a back wall face of a panel. However, in the case of such a connector using means for secure attachment with screws, there have arisen problems in that the number of parts increases because bolts and nuts are required, and work for attachment is bothersome and poor in efficiency because a jig is required for attaching the connector to the panel, or removing the same from the panel.

SUMMARY OF THE INVENTION

The invention has been developed to eliminate the problems described above, and a first object of the invention is to provide a connector with retainer members attachable to a panel from a direction of either a front or back wall face thereof, and easily removable from the panel.

It is another object of the invention to provide a connector with retainer members with enhanced spring stability by preventing concentration of stress on the retainer members.

Further, a still another object of the invention is to provide a method of attaching a connector to a panel, wherein the connector in a predetermined posture can be fitted into an attachment port of the panel when attaching the connector to the attachment port.

The above objects of the invention can be achieved by the following means.

The connector according to the first to sixth aspects of the invention comprises an insulating housing with connector terminals fitted therein, flanges orthogonal to a direction of insertion and removal through the insulating housing and projected outwardly from at least one wall face of the insulating housing, comprising front and back faces, respectively, and a pair of retainer members having flexibility, fixedly attached to both side ends or both up-down ends of the insulating housing, respectively, characterized in that the retainer members are provided with a pair of retainer stepped parts, and there is a gap for allowing fixture of the panel between the front and back faces of the respective flanges and the respective retainer stepped parts of the retainer members.

The pair of retainer stepped parts are inserted into coupling ports of panels such that one retainer stepped part is inserted into a coupling port of a first panel while the other retainer stepped part is inserted into a coupling port of a second panel so that respective panels are retained and secured in the gap between the respective retainer stepped parts and the wall faces of the flanges.

The connector terminals preferably employ male and/or female connectors, connectable to other connectors freely removable from either one end or both ends of the insulating housing.

The freely removable connectors are connected to the connector terminals from either one end or both ends of the connectors. As a result, the connector terminals can be connectable to various electronic equipment by way of the connectors.

The respective retainer members are preferably made up of retainer loops having flexibility, and the respective retainer loops comprise concave grooves provided at the center of an outer wall face opposed to a part of a wall of the housing, to which the respective retainer loops are secured, inclined surfaces provided on both sides of the concave groove, respectively, so as to be inclined outwardly, and a retainer stepped part provided on the respective inclined surfaces.

The retainer loops are preferably formed so as to be substantially uniform in wall thickness or to become smaller in wall thickness from a part of a wall of the housing, to which the respective retainer loops are secured, towards the concave groove, thereby obtaining flexibility.

The retainer stepped part is preferably made up of a stepped part to be engaged with edges of an opening of an attachment port of the panel, and the stepped part is provided in the form of a step or a plurality of steps on the respective inclined surfaces.

A pair of small flanges with a outer width identical to that of aforesaid flange is preferably formed widthwise at the center of the bottom of the concave groove, and outer sidewall faces of the small flange and sidewall faces of aforesaid flange are oriented along the same plane.

Further, since the retainer loops undergo flexure in flat and pass through the attachment port of the panel when it is inserted into the attachment port of the panel, and restore respective original shapes after they passed through the attachment port so that the retainer stepped parts are engaged with the peripheral edge of the attachment port. Since the retainer members are made up of the ring-shaped retainer loops, they function like a double cantilever spring as compared with the conventional panel lock which has been in the form of a cantilever spring, so that concentration of stress can be prevented, and spring strength and spring stability can be enhanced.

The connector according to the seventh aspect of the invention is characterized in that the insulating housing of the connector as in any of the first to sixth aspects of the invention is divided at the flange, as the boundary, into a front housing and a back housing and both the front and back housings differ in external shape from each other.

The connector according to the eighth aspect of the invention is characterized in that the insulating housing of the connector as in any of the first to sixth aspects of the invention is divided at the flange, as the boundary, into a front housing and a back housing and both the front and back housings are substantially identical in external shape.

A method of attaching a connector to a panel according to the ninth aspect of the invention comprises the steps of preparing a connector as in seventh aspect of the invention, and a panel provided with an attachment port for fitting the connector therein, forming the attachment port in the shape substantially identical to an external shape of a front housing of the connector, thereby enabling insertion of the connector into the attachment port from the extremity of the front housing, and causing the extremity of the front housing or a back housing to impinge against a peripheral edge of an opening of the attachment port when an attempt is made to insert the connector with the extremity of the front housing, being upside down, or with the back housing entering first, thereby blocking insertion of the connector.

A method of attaching a connector to a panel according to the tenth aspect of the invention comprises the steps of preparing a connector as in the seventh aspect of the invention, and a panel provided with an attachment port of the panel for fitting the connector therein, forming the attachment port of the panel in the shape substantially identical to an external shape of a front housing or back housing of the connector, thereby enabling insertion of the connector into the attachment port of the panel from the extremity of the front housing or the extremity of the back housing, and causing the extremity of the front housing or a back housing to impinge against a peripheral edge of an opening of the attachment port when an attempt is made to insert the connector from the extremity of the front housing or from the extremity of the back housing, being upside down, thereby blocking insertion of the connector.

A method of attaching a connector to a panel according to the eleventh aspect of the invention comprises the steps of preparing a connector as in the eighth aspect of the invention, and a panel provided with an attachment port for fitting the connector therein, forming the attachment port of the panel in the shape substantially identical to an external shape of a front housing or back housing of the connector, thereby enabling insertion of the connector into the attachment port from the extremity of the front housing or back housing, and causing the extremity of the front housing or a back housing to impinge against a peripheral edge of an opening of the attachment port when an attempt is made to insert the connector from the extremity of the front housing or from the extremity of the back housing, being upside down, thereby blocking insertion of the connector.

A method of attaching a connector to a panel according to the twelfth aspect of the invention comprises the steps of preparing a connector as in the eighth aspect of the invention, and a panel provided with an attachment port for fitting the connector therein, forming the attachment port of the panel in the shape substantially identical to an external shape of a front housing or back housing of the connector, wherein the connector can be inserted into the attachment port from the direction of either the front housing or the back housing, even if being upside down.

The connector is inserted into the attachment port of the panel in a predetermined manner from either a front or back wall face thereof to the panel. With the method of this attachment, the connector can be fitted in the panel, thereby improving design flexibility in connection with connectors, and attachment thereof to a panel.

BRIEF DESCRIPTION OF THE DRAWINGS

FIGS. 1(A) to 1(D) show a plug-type connector according to the present embodiment of the invention, wherein FIG. 1(A) is a plan view of the plug-type connector, FIG. 1(B) is a front view thereof, as seen from the direction of the arrow $Y_1$ in FIG. 1(A), FIG. 1(C) is a rear view thereof, as seen from the direction of the arrow $Y_2$ in FIG. 1(A), and FIG. 1(D) is a bottom view thereof;

FIGS. 2(A) and 2(B) show the plug-type connector of FIG. 1(A), wherein FIG. 2(A) is a side view thereof, as seen from the direction of the arrow X in FIG. 1(A) and FIG. 2(B) is a sectional view thereof, as seen from the direction of the arrows A—A in FIG. 1(A);

FIG. 3(A) is a front view of the panel with the attachment port enabling the plug to be inserted from one direction and FIG. 3(B) is a front view of the panel with the attachment port enabling the plug to be inserted from the other direction;

FIGS. 4(A) and 4(B) show a state where the plug-type connector is attached to the panel, wherein FIG. 4(A) is a perspective view showing a state where the plug-type connector is attached to the panel from one wall face of the panel and FIG. 4(B) is a perspective view showing a state where the plug-type connector is attached to the panel from the other wall face of the panel;

FIGS. 6(A) to 6(C) show a conventional connector, wherein FIG. 6(A) is a perspective view of the connector, FIG. 6(B) and FIG. 6(C) are partially enlarged views thereof when attached to a panel.

PREFERRED EMBODIMENT OF THE INVENTION

An embodiment of the invention is described hereinafter with reference to the accompanying drawings. It is to be pointed out however that the invention is not limited thereto, and various modifications may be made therein by methods that will be described hereinafter as necessary, and structures and functions of such modifications will be easily understood and apparent from the description of the present embodiment, omitting therefore description thereof.

A plug-type connector will be described hereinafter as an electrical connector according to the invention, however, the invention is not limited to the plug-type connector, and is applicable to a receptacle-type connector as well.

Figure 1A:
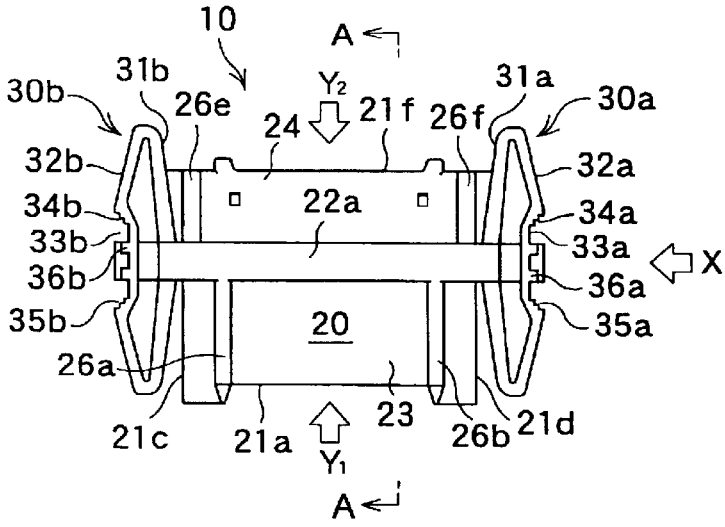
Figure 1B:
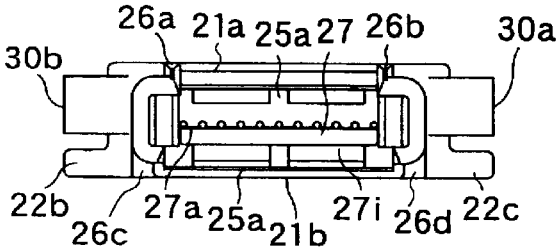
Figure 1C:
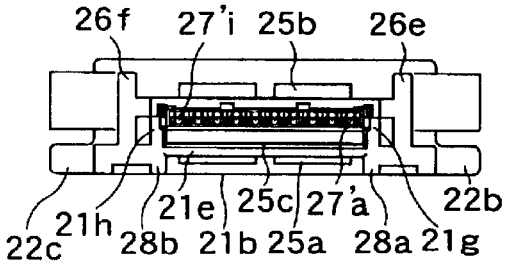
Figure 1D:
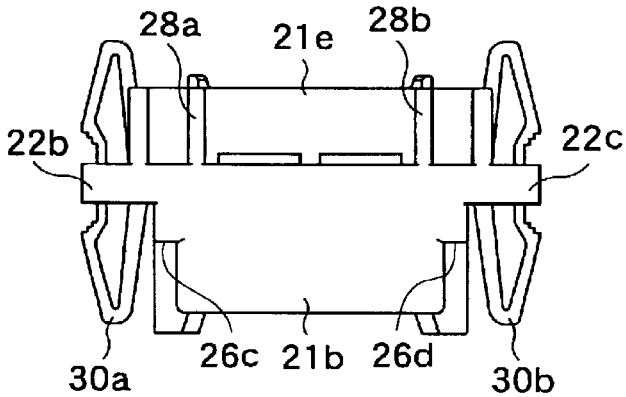
Figure 2A:
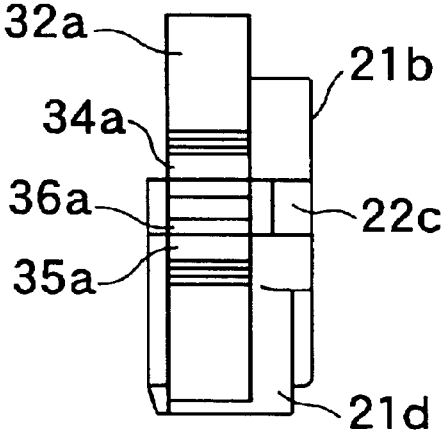
Figure 2B:
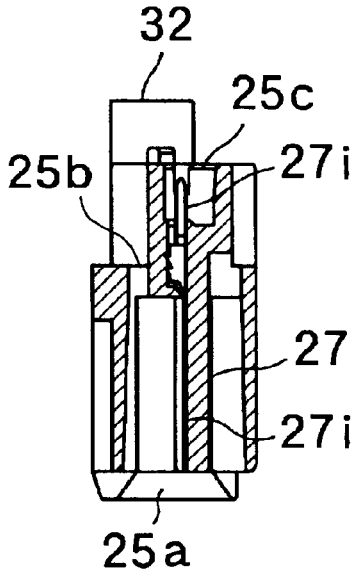

FIGS. 1(A) to 1(D) show a plug-type connector according to the present embodiment of the invention, wherein FIG. 1(A) is a plan view of the plug-type connector, FIG. 1(B) is a front view thereof, as seen from the direction of the arrow $Y_1$ in FIG. 1(A), FIG. 1(C) is a rear view thereof, as seen from the direction of the arrow $Y_2$ in FIG. 1(A), and FIG. 1(D) is a bottom view thereof. FIGS. 2(A) and 2(B) show the plug-type connector of FIG. 1(A), wherein FIG. 2(A) is a side view thereof, as seen from the direction of the arrow X in FIG. 1(A) and FIG. 2(B) is a sectional view thereof, as seen from the direction of the arrows A—A in FIG. 1(A).

A plug-type connector 10 (here in after referred to merely as a plug) comprises a housing proper 20 in flat block shape, and a pair of retainer loops 30*a*, 30*b*, fixedly attached to both sidewalls of the housing proper 20, respectively, and these components are formed of a synthetic resin material, integrally with each other.

The housing proper 20 is divided at a flange 22*a*, as the boundary, into a front housing 23 extending forward, and a back housing 24 extending backward, and the front housing 23 is slightly longer than the back housing 24.

The flange 22*a* formed on an upper wall face 21*a* of the front housing 23 is made up of vertical walls each projected vertically and outwardly, in a predetermined width, from the upper wall face 21*a* of the flat housing, in the direction orthogonal to the direction of the longitudinal axis of the housing. Further, on a lower wall face 21*b*, there are formed flanges 22*b*, 22*c*, with a width identical to that for the flange 22*a*, protruded outwardly from both sidewalls 21*c*, 21*d*, respectively, at a position opposite to the flange 22*a*,. Further, the front housing 23 comprises a slender through-hole 25*a* into which a receptacle (not shown) can be inserted and to which a plurality of connector terminals are fitted, two ribs 26*a*, 26*b*, protruding in the vicinity of both edges of the upper wall face 21*a*, respectively, and steps 26*c*, 26*d* provided at both edges of the lower wall face 21*b*, respectively. The two ribs 26*a*, 26*b* and the steps 26*c*, 26*d* fulfill a function of positioning at the time of coupling with the receptacle, thereby blocking coupling in a wrong direction. These also fulfill a function of blocking insertion of the connector into the attachment port of the panel, not matching a shape of the front housing 23. That is, because the two ribs 26*a*, 26*b* of the upper wall face 21*a* are formed at different positions, respectively, these ribs will be butted against a peripheral face of the attachment port of the panel in the case of fitting the plug 10 in an inverted position, thereby preventing insertion thereof in a wrong way.

Further, with the slender through-hole 25*a*, peripheral corners thereof are chamfered, a deck 27 is formed widthwise therein, and a plurality of connector terminals 27*a* to 27*i* are fitted onto the deck 27.

The back housing 24 comprises a slender through-hole 25*b* linked with the slender through-hole 25*a*, two ribs 26*e*, 26*f*, protruded upward from both edges of an upper face wall 21*f*, respectively, two ribs 28*a*, 28*b*, protruded from both edges of lower face wall 21*e*, respectively, and a slender hole 25*c* defined by the upper face wall 21*f*, the lower face wall 21*e*, and sidewall faces, 21*g*, 21*h*, on the left and right sides, respectively, and further, inside of the slender hole 25*c*, there are protruded connector pins 27'*a* to 27'*i*, linked with the connector terminals 27*a* to 27*i*, respectively.

The connector terminals 27*a* to 27*i* each are made up of a flat strip-like contact piece and a pin-like terminal linked therewith. FIG. 2(B) shows a state where one of the connector terminals is fitted to the housing. With the use of these connector terminals, other connector (not shown) can be removably coupled with both edges of the through-hole 25*a* and the slender hole 25*c*, respectively. Further, the connector terminals are not limited in shape to such a shape as described above, and connector terminals in optional shape such as a female connector and/or male connector, (not shown), or the like may be employed.

Still further, these connector terminals may be removably fitted inside the through-hole or the slender hole to be removed when electrical connection is unnecessary, and the holes after removal of the connector terminals can be filled up with a removable stopper (not shown).

The pair of the retainer loops 30*a*, 30*b* are fixedly attached to both the right-side and left-side ends of the flange 22*a* of the housing proper 20, respectively. The retainer loops 30*a*, 30*b* are identical in shape. For brevity in description, only one of the retainer loops, 30*a*, is described hereinafter. As to the other retainer loop 30*b*, parts are denoted by the identical number with a suffix b added thereto, thereby omitting description thereof.

The retainer loop 30*a* is formed substantially in the external shape of a rhombus in a plan view, with space substantially in rhombus-like shape defined therewithin, and is made up of a loop-shaped body having a predetermined width and wall thickness. The retainer loop 30*a* is divided vertically into inner and outer two loop-shaped pieces 31*a*, 32*a*, along a line interconnecting opposite angles of the rhombus-like shape, in the longitudinal direction thereof, and one of the loop-shaped pieces, 31*a*, is relatively large in wall thickness while the other loop-shaped piece 32*a* is formed smaller in wall thickness. Of the loop-shaped pieces 31*a*, 32*a*, obtained by halving the retainer loop 30*a*, the center of the outer wall of the loop-shaped piece 31*a* larger in wall thickness is fixedly attached to the end of the flange 22*a* of the housing proper 20 while a concave groove 33*a* is formed at the center of the loop-shaped piece 32*a* smaller in wall thickness. The retainer loops 30*a*, 30*b* preferably have a length, that is, a length in the longitudinal direction of the rhombus-like shape thereof, respectively, such that the tip thereof is substantially flush with the tip of the front housing 23, and the back housing 24, respectively. Obviously, the length is subject to change to a suitable length depending on dimensions of the housing proper 20 or thickness of the panel to which attachment is to be made.

The concave groove 33*a* is provided with inclined surfaces 34*a*, 35*a*, inclined at a predetermined angle, respectively, on both sides thereof, and a stepped part to be engaged with edges of the opening of an attachment port of a panel is provided in the form of a step or a plurality of steps on the respective inclined surfaces. Further, a pair of small flanges 36*a* with a outer width identical to that of the flange 22*a* is provided at the center of the concave groove 33*a*, and is formed such that outer sidewall faces of the small flanges 36*a* are oriented along the same plane as a plane along which side faces of the flanges 22*a*, 22*b*, 22*c*, respectively, are oriented.

By positioning the side faces of the flanges 22*a*, 22*b*, 22*c*, and 36*a*, respectively, so as to be oriented along the same plane, the panel is butted against the side faces of the respective flanges upon attaching the plug to the panel, thereby implementing positioning of the plug in the panel. As shown in FIG. 1(A), the small flanges 36 is provided with two rib-like projections with a predetermined spacing therebetween, however, may be provided with one rib-like projection of a predetermined width instead.

As described in the foregoing, both the retainer loop 30*a*, and the retainer loop 30*b* are identical in structure. Also, the respective retainer loops 30*a*, 30*b* can be modified in detailed structure. Further, the respective retainer loops 30*a*, 30*b* have a structure with flexibility while maintaining mechanical strength, and such flexibility can be maintained by reducing the wall thickness of the respective retainer loops, in belt-like form, gradually from a fixed part of a inner wall thereof towards the concave grooves 33*a*, 33*b* or the flexibility and mechanical strength can also be maintained by keeping the wall thickness uniform without varying the same.

Further, the retainer loops 30*a*, 30*b* can be formed in any suitable external shape such as an ellipse, a flat block, or the like instead of a rhombus.

Still further, the retainer loops 30*a*, 30*b* maybe fixedly attached to the sidewalls 21*c*, 21*d*, the upper and lower wall faces 21*a*, 21*b*, or the peripheral wall faces 21*a* to 21*d*, respectively, in place of the end of the flange 22*a*, on both sides of the housing proper 20. Needless to say, such modification will entail modification in the shape of the housing proper.

Figure 3A:
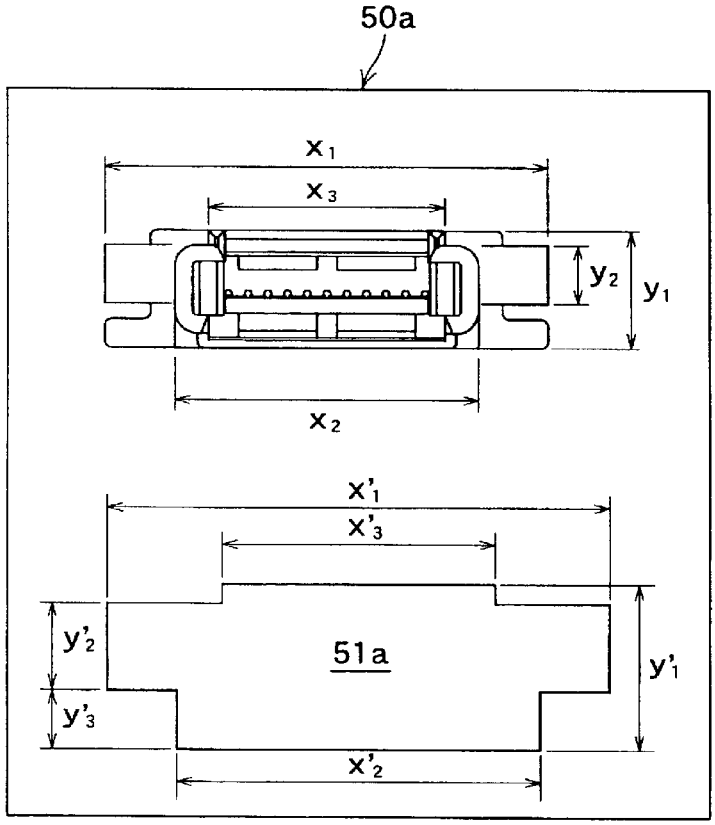
FIGS. 3(A) and 3(B) show relationship between the shape of an attachment port of a panel and a plug-type connector.
Figure 3B:
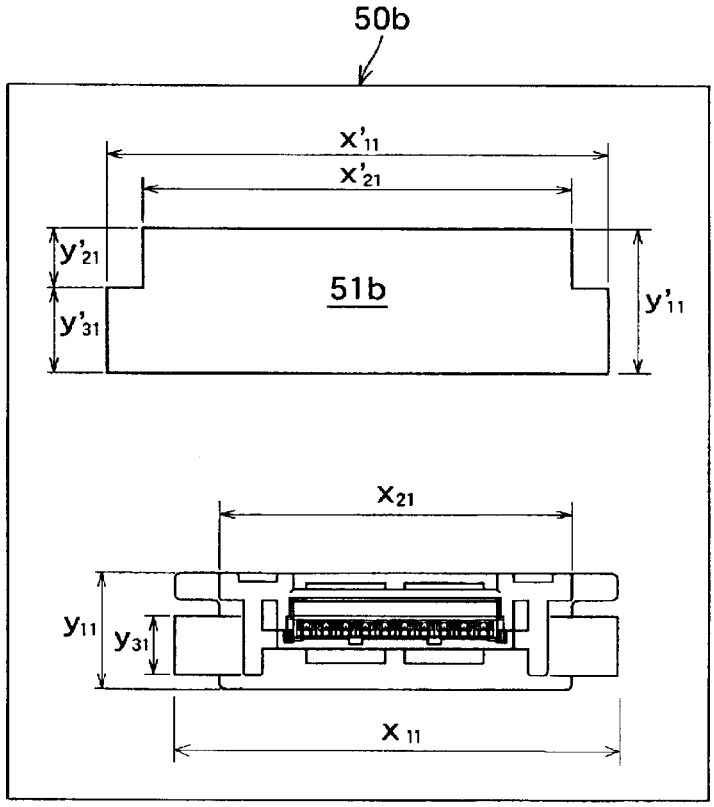
Figure 4A:
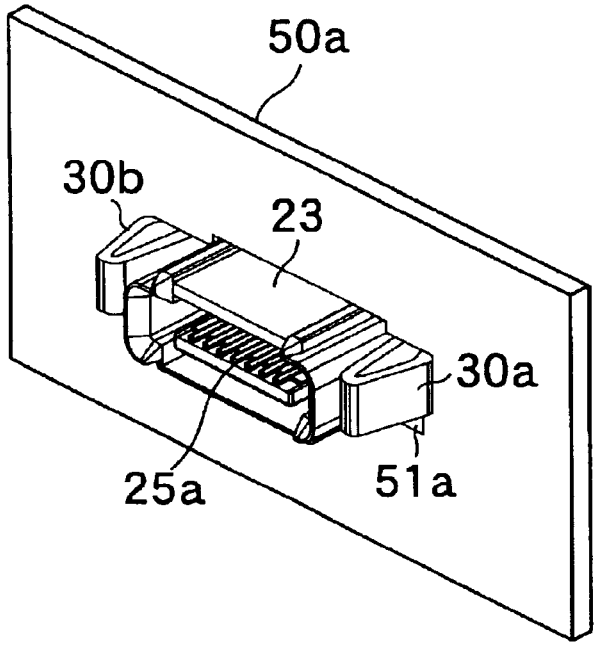
Figure 4B:
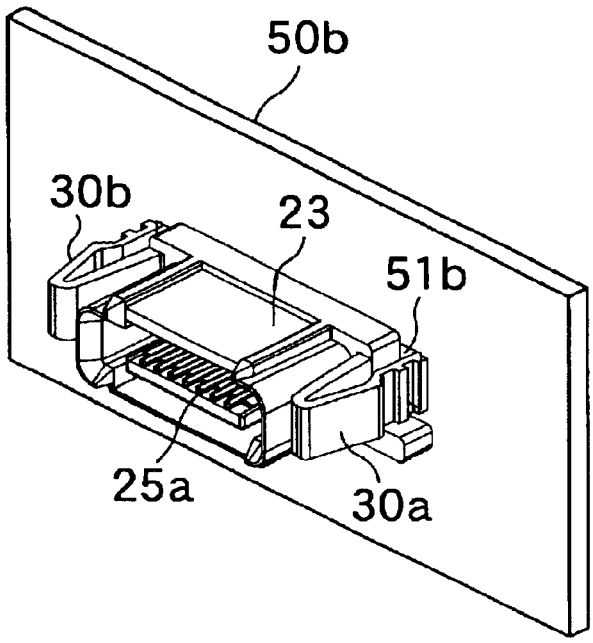

FIGS. 3(A) and 3(B) show relationship between the shape of an attachment port of a panel and a plug, wherein FIG. 3(A) is a front view of the panel with the attachment port enabling the plug to be inserted from one direction, and FIG. 3(B) is a front view of the panel with the attachment port enabling the plug to be inserted from the other direction. In FIGS. 3(A) and 3(B), the plug is shown on the panel, however, these figures are merely to illustrate with greater ease relationship between a direction of plug insertion and the attachment port, and are not intended to show the plug actually placed on the panel. FIGS. 4(A) and 4(B) are perspective views showing a condition of the plug attached to the panel, corresponding to FIGS. 3(A) and 3(B), respectively.

The panel is provided with the attachment port for fitting the plug thereinto. With the plug 10, since the shape of the front housing 23 is different from that of the back housing 24, two different panels are prepared, and attachment ports in different shapes are formed in the panels, respectively.

In FIG. 3(A), there is shown a shape of an attachment port 51*a* into which the plug 10 is inserted with the front housing 23 entering first. The attachment port 51*a* is formed in the shape of the slender hole with lengths $y'_1$, $x'_1$, shown in FIG. 3(A), so as to match an external shape of the front housing 23. $y_1$ corresponds to a vertical width of the front housing 23, $y_2$ is a vertical width of the retainer members 30*a*, 30*b*, and $y_3$ is a length obtained by subtracting $y_2$ from $y_1$, respectively. The lengths $y'_1$ to $y'_3$ of the attachment port 51*a* are rendered slightly wider than the vertical widths ($y_1$, $y_3$) of the front housing 23 to allow the front housing 23 to be inserted into the slender hole. Similarly, $x_1$ corresponds to a distance between the outer sides of the retainer members 30*a*, 30*b*, respectively, $x_2$ is a horizontal width of the front housing 23, and $x_3$ is a distance between the two ribs 26*a*, 26*b*, respectively. The lengths $x'_1$ to $x'_3$ of the attachment port 51*a* are rendered slightly longer than the lengths of corresponding parts of the front housing 23, respectively.

In FIG. 3(B), there is shown a shape of an attachment port 51*b* into which the plug 10 is inserted with the back housing 24 entering first.

The attachment port 51*b* is formed in the shape of the slender hole with lengths $y'_{11}$, $x'_{11}$, shown in FIG. 3(B), so as to match an external shape of the back housing 24. $y_{11}$ corresponds to a vertical width of the back housing 24, $y_{31}$ corresponds to a vertical width of the retainer members 30*a*, 30*b*, and $y_{21}$ corresponds to a length obtained by subtracting $y_{31}$ from $y_{11}$, respectively. The lengths $y'_{11}$ to $y'_{31}$ of the attachment port 51*b* are rendered slightly longer than the vertical widths ($y_{11}$ to $y_{31}$) of the back housing 24 to allow the back housing 24 to be inserted into the slender hole. Similarly, $x_{11}$ corresponds to a distance between the outer sides of the retainer members 30*a*, 30*b*, respectively, and $x_{21}$ corresponds to a horizontal width of the back housing 24, the lengths $x'_{11}$ and $x'_{21}$ of the attachment port 51*b* are rendered slightly longer than the lengths of corresponding parts of the back housing 24, respectively.

The plug 10 is attached to the respective panels 50*a*, 50*b* by the following method.

(i) In the case of attaching the plug 10 to the attachment port 51*a* of the panel with the front housing 23 first or removing the plug 10 from the attachment port 51*a* of the panel, the plug 10 is inserted into the attachment port 51*a* with the front housing 23 thereof, provided with a pair of the ribs 26*a*, 26*b*, facing upwards, whereupon the extremity of the respective retainer loops 30*a*, 30*b* is butted against the edge of the opening of the slender hole of the attachment port 51*a*, thereby enabling insertion of the plug 10. At this point in time, the ribs 26*a*, 26*b*, are inserted into an upper groove of the edges of the opening, respectively, so that insertion of the front housing 23 will not be blocked. When the plug 10 is further pushed in, both the loop-shaped pieces 32*a*, 32*b*, smaller in wall thickness and butted against the edges of the opening of the slender hole, respectively, undergo flexure in the direction approaching the housing, so that the space, substantially in the rhombus-like shape, within the retainer loops 30*a*, 30*b*, respectively, is lessened, thereby allowing the retainer loops 30*a*, 30*b* to pass through the attachment port. Upon the apex of the inclined surfaces 34*a*, 34*b*, respectively, passing through the opening, the respective retainer loops 30*a*, 30*b* restore respective original shapes by the agency of elastic restoring force. As a result of such restoration of the shapes, one wall face of the panel 50*a* is butted against one wall face of the flange 22*a* while the edge of the attachment port 51*a*, on the other wall face, is retained by the stepped part of the inclined surfaces 34*a*, 35*a*, respectively. The condition of such retainment is as shown in FIG. 4(A).

If an attempt is made to insert the plug 10 into the attachment port 51*a* with the front housing 23 provided with the pair of the ribs 26*a*, 26*b*, directly downwardly, that is, after turning the face of the front housing 23 through 180°, the distance between the two ribs 26*a*, 26*b*, a width of the steps 26*c*, 26*d*, respectively, or an attachment position of the respective retainer loops 30*a*, 30*b*, relative to the opening, do not coincide with corresponding the shape of the opening of the attachment port 51*a*, thereby preventing the plug 10 from being inserted into the attachment port 51*a*.

Further, in the case of enabling the plug 10 to be inserted with the back housing 24 entering the attachment port 51*a* first, an external shape of the back housing 24 is caused to match a shape of the attachment port 51*a* or the external shape of the back housing 24 is rendered slightly smaller to allow insertion of the plug 10.

In the case of removing the plug 10 from the panel 50*a*, the loop-shaped pieces 32*a*, 32*b* of the retainer loops 30*a*, 30*b*, respectively, are pinched and pressed with a thumb and a forefinger thereby cause the loop-shaped pieces 32*a*, 32*b* to undergo flexure before removing the plug 10 from the panel 50*a* by pulling the plug 10 out of the panel 50*a* in the direction opposite to the direction of insertion.

(ii) In the case of attaching the plug 10 to the attachment port 51*b* of the panel with the back housing 24 first or removing the plug 10 from the attachment port 51*b*, the plug 10 is inserted into the attachment port 51*b* with the back housing 24 thereof, provided with a pair of the ribs 28*a*, 28*b*, facing downwards, whereupon the extremity of the respective retainer loops 30*a*, 30*b* is butted against the edge of the opening of the slender hole of the attachment port 51*b*, thereby enabling insertion of the plug 10. When the plug 10 is further pushed in, both the loop-shaped pieces 32*a*, 32*b*, smaller in wall thickness and butted against the edges of the opening of the slender hole, respectively, undergo flexure in the direction approaching the housing, so that the space, substantially in the rhombus-like shape, within the retainer loops 30*a*, 30*b*, respectively, is lessened, thereby allowing the retainer loops 30*a*, 30*b* to pass through the attachment port. Upon the apex of the inclined surfaces 34*a*, 34*b*, respectively, passing through the attachment port 51*b*, the respective retainer loops 30*a*, 30*b* restore respective original shapes by the agency of elastic restoring force. As a result of such restoration of the shapes, one wall face of the panel 50*b* is butted against one wall face of the flange 22*a* while the edge of the attachment port 51*b*, on the other wall face, is retained by the stepped part of the inclined surfaces 34*a*, 35*a*, respectively. The condition of such retainment is as shown in FIG. 4(B).

If an attempt is made to insert the plug 10 into the attachment port 51*b* with the back housing 24 provided with the pair of the ribs 28*a*, 28*b*, directed upwardly, the ribs 28*a*, 28*b* impinge against a peripheral edge of the attachment port 51*b*, thereby preventing the plug 10 from being inserted into the attachment port 51*b*.

In the case of removing the plug 10 from the panel 50*b*, the loop-shaped pieces 32*a*, 32*b* of the retainer loops 30*a*, 30*b*, respectively, are pinched and pressed with a thumb and a forefinger thereby cause the loop-shaped pieces 32*a*, 32*b* to undergo flexure before removing the plug 10 from the panel 50*a* by pulling the plug 10 out of the panel 50*a* in the direction opposite to the direction of insertion.

The plug 10 is divided into the front housing 23 and the back housing 24, and both the housings differ in external shape from each other. Further, the ribs on the wall face and the stepped part are formed at different positions, however, by suitably changing these shapes and/or positions of the ribs and the stepped part in relation to the shape of the attachment port of the panel, for example, by forming the front housing 23 and the back housing 24 in an identical shape or modifying the shape thereof, the plug 10 can be fitted in the attachment port in an optional shape.

Figure 5:
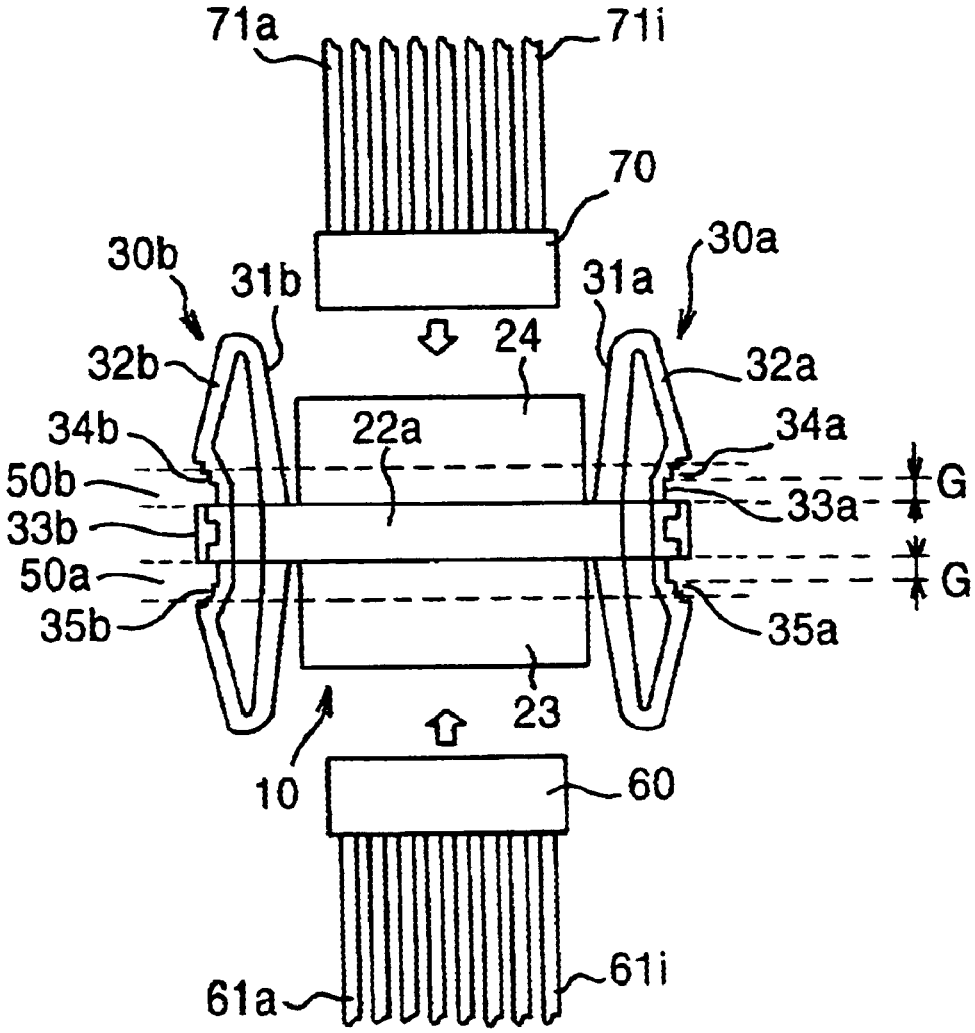
FIG. 5 is a plan view for illustrating connection of a connector attached to the panel to other connectors.
Figure 6A:
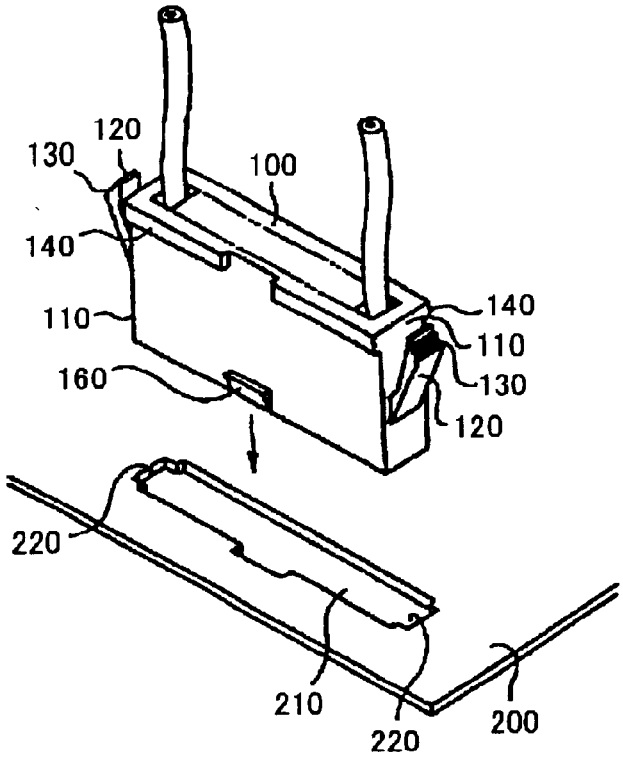
Figure 6B:
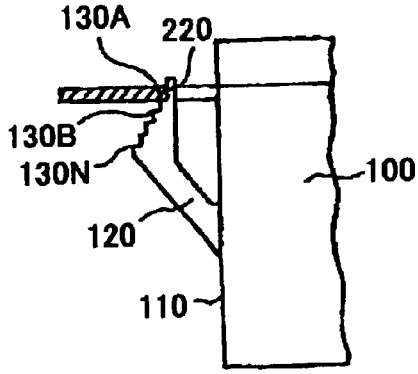
Figure 6C:
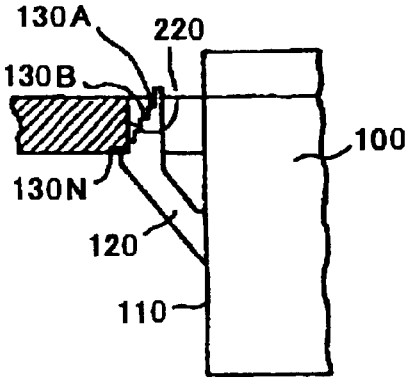

FIG. 5 is a plan view for illustrating connection of a connector attached to the panel to other connectors.

A connector 10 is fitted to either a panel 50*a* or a panel 50*b* by the previously described method. Other connectors 60, 70 have lead wires 61*a* to 61*i*, and 71*a* to 71*i*, respectively, connected to other electronic equipment, or the like. In the case of connecting together the electronic equipment, or the like, connected to the connectors 60, 70, respectively, through the intermediary of the connector 10, the connector 60 is inserted into the front housing 23 of the connector 10, and the connector 70 is inserted into the back housing 24 thereof, thereby implementing connection.

With the constitution as described above being adopted, the invention can provide a connector comprising retainer members that can be attached to a panel from either the direction of the front face of the panel or the direction of the back face thereof and that can be easily removed from the panel.

Further, since the retainer member is made up of the loop-shaped retainer pieces, functioning like a double cantilever spring as compared with the conventional panel lock which has been in the form of a cantilever spring, concentration of stress can be prevented, so that spring strength and spring stability can be enhanced. The invention further provides a method of attaching the connector to a panel, enabling the connector to be fitted to the panel from a given direction of attachment when attaching the connector to an attachment port of the panel.

What is claimed is:

1. A connector attachable to a panel from either a front or back wall face thereof, comprising:

an insulating housing with connector terminals fitted therein;

flanges orthogonal to a direction of insertion and removal through the insulating housing and projected outwardly from at least one wall face of the insulating housing, comprising front and back wall faces, respectively; and a pair of retainer members having flexibility, fixedly attached to both sidewalls of the insulating housing, respectively, wherein the retainer members are provided with a pair of retainer stepped parts, facing each other, and there is a gap for allowing fixture of the panel between the front and back faces of the respective flanges and the respective retainer stepped parts of the retainer members.

2. The connector with retainer members attachable to a panel from either a front or back wall face thereof according to claim 1, wherein the connector terminals are male or female connectors, connectable to other connectors freely removable from either one end or both ends of the insulating housing.

3. The connector with retainer members attachable to a panel from either a front or back wall face thereof according to claim 1, wherein the respective retainer members are made up of ring-shaped retainer loops having flexibility, and the respective retainer loops comprise concave grooves provided at the center of an outer wall face opposed to a part of a wall of the insulating housing, to which the respective retainer loops are secured, inclined surfaces provided on both sides of the concave groove, respectively, so as to be inclined outwardly, and a retainer stepped part provided on the respective inclined surfaces.

4. The connector with retainer members attachable to a panel from either a front or back wall face thereof according to claim 3, wherein the retainer loops are formed so as to be substantially uniform in wall thickness or to become smaller in wall thickness from a part of a wall of the insulating housing, to which the respective retainer loops are secured, towards the concave groove, thereby obtaining flexibility.

5. The connector with retainer members attachable to a panel from either a front or back wall face thereof according to claim 3, wherein the retainer stepped part is made up of a stepped part to be engaged with edges of an opening of an attachment port of the panel, and the stepped part is provided in the form of a step or a plurality of steps on the respective inclined surfaces.

6. The connector with retainer members attachable to a panel from either a front or back wall face thereof according to claim 3, wherein a pair of small flanges with a outer width identical to that of aforesaid flange is formed widthwise at the center of the bottom of the concave grooves, and front and back faces on both sides of the small flanges and sidewall faces on both outsides of aforesaid flange are oriented along the same plane.

7. The connector with retainer members attachable to a panel from either a front or back wall face thereof according to any of claims 1 to 6, wherein the insulating housing of the connector is divided at the flange, as the boundary, into a front housing and a back housing and both the front and back housings differ in external shape from each other.

8. The connector with retainer members attachable to a panel from either a front or back wall face thereof according to any of claims 1 to 6, wherein the insulating housing of the connector is divided at the flange, as the boundary, into a front housing and a back housing and both the front and back housings are substantially identical in external shape.

* * * * *